US008842103B2

(12) United States Patent
Woo et al.

(10) Patent No.: US 8,842,103 B2
(45) Date of Patent: Sep. 23, 2014

(54) METHOD OF DRIVING LIQUID CRYSTAL DISPLAY PANEL AND LIQUID CRYSTAL DISPLAY APPARATUS PERFORMING THE SAME

(75) Inventors: Hwa-Sung Woo, Asan-si (KR); Dong-Gyu Kim, Yongin-si (KR); Kye-Hun Lee, Asan-si (KR); Hyang-Yul Kim, Hwaseong-si (KR); Joo-Nyung Jang, Hwaseong-si (KR)

(73) Assignee: Samsung Display Co., Ltd. (KR)

( * ) Notice: Subject to any disclaimer, the term of this patent is extended or adjusted under 35 U.S.C. 154(b) by 424 days.

(21) Appl. No.: 13/029,077

(22) Filed: Feb. 16, 2011

(65) Prior Publication Data

US 2012/0056856 A1 Mar. 8, 2012

(30) Foreign Application Priority Data

Sep. 7, 2010 (KR) ..... 10-2010-0087415

(51) Int. Cl.
*G09G 5/00* (2006.01)
*G09G 3/36* (2006.01)
*G09G 3/00* (2006.01)

(52) U.S. Cl.
CPC ..... *G09G 3/3648* (2013.01); *G09G 2320/0209* (2013.01); *G09G 2300/0447* (2013.01); *G09G 2320/106* (2013.01); *G09G 2340/0435* (2013.01); *G09G 2310/061* (2013.01); *G09G 3/003* (2013.01)
USPC ..... 345/204; 348/51; 348/56

(58) Field of Classification Search
CPC ..... G09G 3/3648; G09G 2300/0447; G09G 3/003; G09G 2320/0209; G09G 2320/106; G09G 2310/061
USPC ..... 345/6, 42–60, E13.037–E13.041; 353/17; 349/15; 359/462–477
See application file for complete search history.

(56) References Cited

U.S. PATENT DOCUMENTS

| | | | | |
|---|---|---|---|---|
| 4,719,507 | A * | 1/1988 | Bos | 348/57 |
| 6,448,952 | B1 * | 9/2002 | Toyoda et al. | 345/97 |
| 7,391,398 | B2 * | 6/2008 | Inoue | 345/89 |
| 7,825,999 | B2 * | 11/2010 | Chestak et al. | 349/15 |
| 2007/0263937 | A1 * | 11/2007 | Rizko | 382/232 |

(Continued)

FOREIGN PATENT DOCUMENTS

| | | | |
|---|---|---|---|
| JP | 2000-284224 | A | 10/2000 |
| KR | 1020030088244 | A | 11/2003 |
| KR | 1020060093610 | A | 8/2006 |

*Primary Examiner* — Amare Mengistu
*Assistant Examiner* — Vinh Lam
(74) *Attorney, Agent, or Firm* — Innovation Counsel LLP

(57) ABSTRACT

A method of driving liquid crystal display panel includes generating a plurality of eye data frames from a received frame of image data. A high data frame having a first liquid crystal rotating attribute and a low data frame having a lesser second liquid crystal rotating attribute are respectively generated from a respective two of the generated plurality of eye data frames. The high data frame and the low data frame are alternatingly used to drive the liquid crystal display panel according to a time division rate such that liquid crystal molecules are subjected to low and higher crystal rotating forces. In one embodiment, each pixel is space-divided into first and second sub areas having different distances between the first and second pixel electrodes, and the high data and the low data are time-divided and displayed on the pixel, enhancing visibility of the resulting image for different viewing angles.

8 Claims, 11 Drawing Sheets

(56) References Cited

U.S. PATENT DOCUMENTS

| | | | | |
|---|---|---|---|---|
| 2009/0052027 | A1 | 2/2009 | Yamada et al. | |
| 2009/0219382 | A1* | 9/2009 | Routhier et al. | 348/43 |
| 2009/0237495 | A1* | 9/2009 | Kawahara | 348/56 |
| 2011/0007136 | A1* | 1/2011 | Miura et al. | 348/46 |
| 2011/0018983 | A1* | 1/2011 | Kim et al. | 348/56 |
| 2011/0032241 | A1* | 2/2011 | Jeong et al. | 345/212 |
| 2011/0050748 | A1* | 3/2011 | Tsuchiya et al. | 345/690 |
| 2011/0080470 | A1* | 4/2011 | Kuno et al. | 348/46 |
| 2011/0149220 | A1* | 6/2011 | Byun et al. | 349/123 |

* cited by examiner

METHOD OF DRIVING LIQUID CRYSTAL DISPLAY PANEL AND LIQUID CRYSTAL DISPLAY APPARATUS PERFORMING THE SAME

PRIORITY STATEMENT

This application claims priority under 35 U.S.C. §119 to Korean Patent Application No. 2010-87415, filed on Sep. 7, 2010 in the Korean Intellectual Property Office (KIPO), the contents of which are herein incorporated by reference in their entireties.

BACKGROUND OF THE INVENTION

1. Field of the Invention

Embodiments of the present invention relate generally to flat panel displays. More specifically, embodiments of the present invention relate to methods for driving a liquid crystal display panel, and liquid crystal display apparatuses for performing the methods.

2. Description of the Related Art

A liquid crystal display (LCD) is a display apparatus typically having two glass substrates and a liquid crystal disposed between the glass substrates. The liquid crystal is an intermediate matter between a solid and a liquid. The LCD changes an arrangement of the liquid crystal molecules according to a voltage difference, so as to generate images. However, the LCD commonly has relatively slow response speed, low resolution and narrow viewing-angle, which are disadvantages.

Recently, demand for displays capable of producing three-dimensional (3-D) images has increased. Accordingly, demand has risen for 3-D capable LCDs. A 3-D image is commonly displayed using a binocular parallax principle through both eyes. For example, in a liquid crystal shutter stereoscopic type display apparatus, a viewer wears a pair of glasses which sequentially open and close a left eye liquid crystal shutter and a right eye liquid crystal shutter in synchronization with the display of left and right eye frame images. This LCD is typically driven based on a progressive scan method, which produces crosstalk due to a difference between grayscales of two images while changing from a left eye image (or a right eye image) to the right eye image (or the left eye image). This crosstalk decreases the display quality. Thus, a black image is inserted between the left eye image and the right eye image, typically with a driving frequency of 240 Hz, so as to prevent crosstalk and enhance display quality.

SUMMARY OF THE INVENTION

Example embodiments of the present invention provide methods for driving a liquid crystal display (LCD) panel with improved visibility.

Example embodiments of the present invention also provide an LCD apparatus performing the methods.

According to one aspect of the present invention, there is provided a method of driving an LCD panel. In the method, a plurality of data frames is generated from a data frame. A high data frame having a high luminance and a low data frame having a low luminance are generated two of the data frames. The high data frame and the low data frame are displayed on the LCD panel according to a time division rate.

According to one aspect of the present invention, an LCD apparatus includes an LCD panel, a frame rate controller, a data generator and a panel driver. The LCD panel includes a plurality of pixels. The frame rate controller generates a plurality of data frames from a data frame. The data generator generates a high data frame having a high luminance and a low data frame having a low luminance from two of the data frames. The panel driver displays the high data frame and the low data frame on the LCD panel according to a time division rate.

According to the present invention, the high data and the low data are time-divided and are displayed on the pixel, and thus a visibility may be enhanced. In addition, the high data and the low data are time-divided and are displayed on the pixel space-divided into first and second subareas in which distances between first and second pixel electrodes are different from each other, and thus the visibility may be further enhanced.

BRIEF DESCRIPTION OF THE DRAWINGS

The above and other features and advantages of the present invention will become more apparent by describing in detail the preferred embodiments thereof with reference to the accompanying drawings, in which.

DETAILED DESCRIPTION OF THE INVENTION

Hereinafter, the present invention will be explained in detail with reference to the accompanying drawings. Measured numerical quantities, ranges, ratios and the like are approximate, and the invention includes other quantities, ranges, ratios, etc. besides only those listed.

Figure 1:
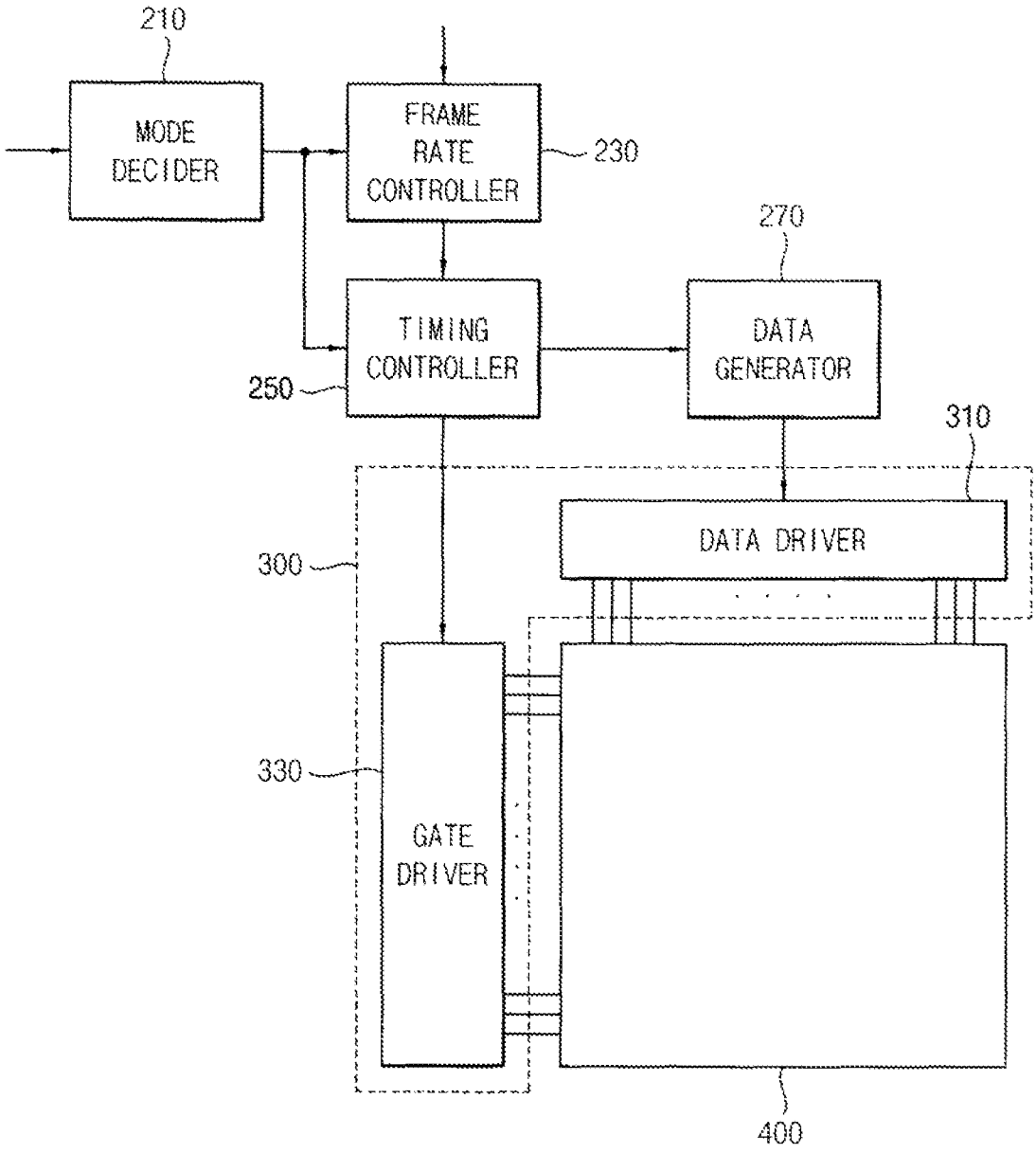
FIG. 1 is a plan view illustrating a liquid crystal display apparatus according to an example embodiment of the present invention.
Figure 2A:
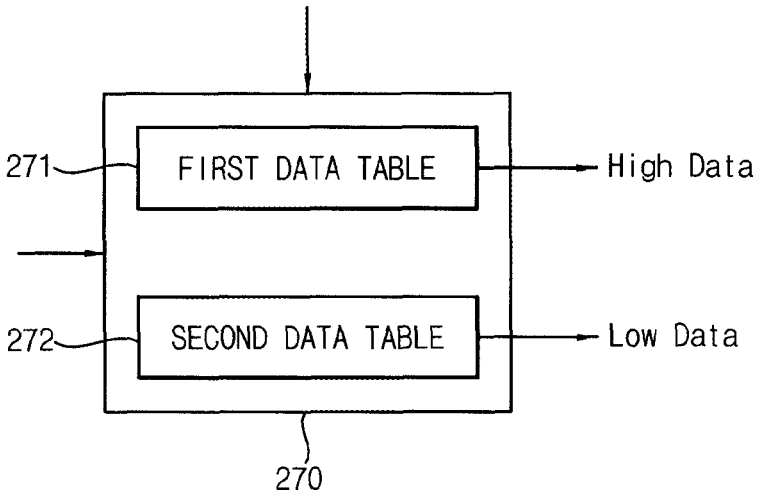
FIG. 2A is a block diagram illustrating a data generator in FIG. 1.
Figure 2B:
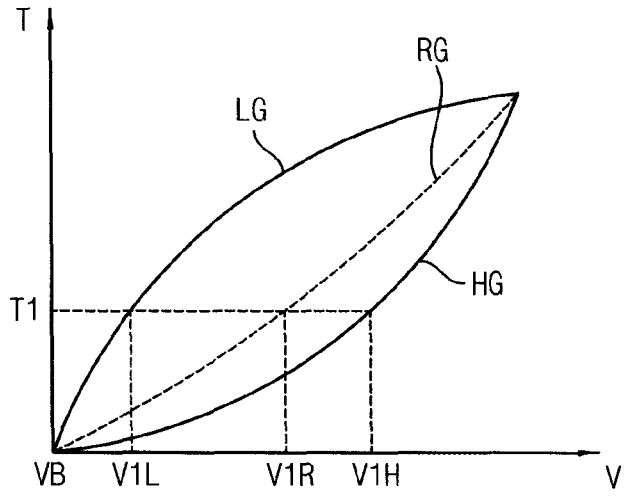
FIG. 2B is a gamma curve adjusted to the data generator in FIG. 2A.

FIG. 1 is a plan view illustrating a liquid crystal display (LCD) apparatus according to an example embodiment of the present invention. FIG. 2A is a block diagram illustrating a data generator in FIG. 1. FIG. 2B is a gamma curve adjusted to the data generator in FIG. 2A.

Referring to FIG. 1, the LCD apparatus includes a mode decider 210, a frame rate controller 230, a timing controller 250, a data generator 270, a panel driver 300 and an LCD panel 400.

The mode decider 210 decides an image mode of received data. The mode decider 210 decides the image mode of the received data according to a received synchronizing signal, a mode information signal, or the like, or decides the image mode of the received data according to a mode signal selected by a user. For example, the mode decider 210 decides whether the received data are two-dimensional (2-D) image modes or three-dimensional (3-D) image modes. The frame rate controller 230, the timing controller 250 and the data generator 270 are driven according to the image mode decided by the mode decider 210.

Figure 4:
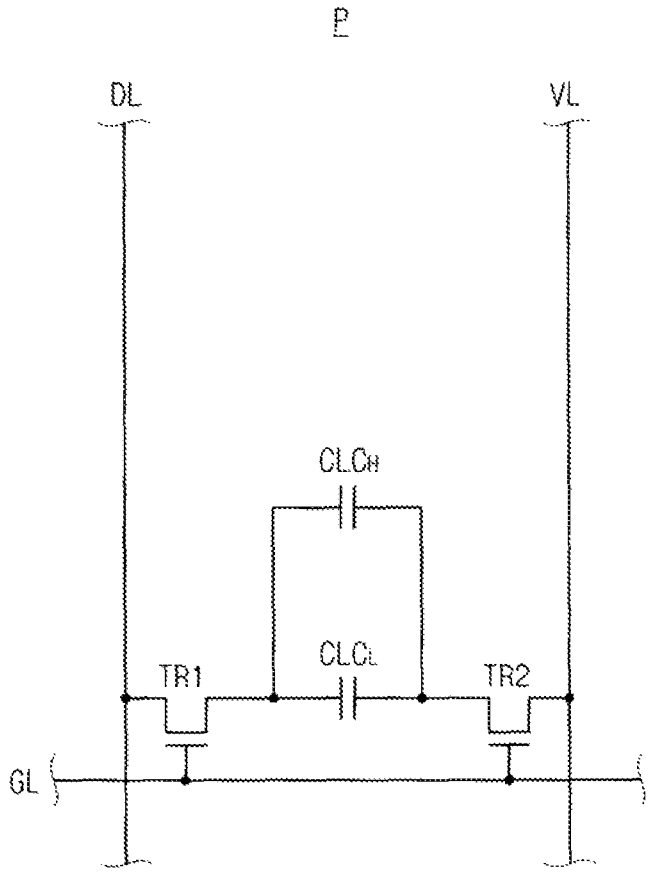
FIG. 4 is an equivalent circuit diagram of the liquid crystal display panel in FIG. 3.

The frame rate controller (FRC) 230 generates a plurality of "eye" data frames from the received data (e.g., frames specific to one or the other of the user's eyes). An eye data frame is defined as image data within a frame unit. A frame unit includes an application of alternating polarities as shall be made clearer when FIG. 4 is described.

When the received data are in 3-D image mode, the frame rate controller 230 divides the received data into left eye data and right eye data, and scales the left eye data and the right eye data to the data frames corresponding to a resolution of the LCD panel 400, repeating the scaled left and right eye data L and R, and generates N, (N is M/2 and a natural number, and M is not less than 8 and a natural number) left eye data frames and N right eye data frames so that, in total, M data frames are generated. When the received data are in 2-D image mode, the frame rate controller 230 generates (N−1) data frames using the present data frame and a following frame, and doubles the present data frame and (N−1) data frames to generate a total of M data frames.

The timing controller 250 provides the data frames generated by the frame rate controller 230 to the data generator 270. When the received data are 3-D image mode data, the timing controller 250 inserts a black data frame between the left eye data frame and the right eye data frame. For example, the timing controller 250 sequentially outputs (N−1) left eye data frames, a left eye black data frame, (N−1) right eye data frames and a right eye black data frame. When the received data are in 2-D image mode, the timing controller 250 provides the M data frames to the data generator 270 without alternation.

Referring to FIGS. 2A and 2B, the data generator 270 generates a high data frame or a low data frame from each of the M data frames according to image mode and a preset time-division rate based on the image mode, and outputs the high data frame or the low data frame.

The data generator 270 includes first and second data tables 271 and 272 that correspond to different levels of DL voltages applied in the circuit of FIG. 4 for subjecting the liquid crystals to correspondingly opposed polarities and different drive voltages. High data corresponding to input data are stored in the first data table 271. A high gamma curve HG, which for a given desired luminance value (T1—can be any horizontal line) calls for a high data line drive voltage (V1H) disposed on one side of a reference voltage (V1R) for realizing that same luminance (T1) when using a predetermined reference gamma curve RG, is applied for the high data. Low data corresponding to the input data are stored in the second data table 272. The low gamma curve LG, which for a given desired luminance value (T1) calls for a lower data line drive voltage (V1L) disposed on an opposed side of the reference voltage (V1R) for that same luminance (T1) when using the predetermined reference gamma curve RG, is applied for the low data. The data generator 270 converts each of the M data frames to be high data or low data using the first and second data tables 271 and 272 with a time-division rate which is preset as I:J (each of I and J is no less than 1 and is also a natural number) on the high data frame and the low data frame according to the image mode. In other words, the data generator 270 receives image frames, and applies either a high gamma curve or a low gamma curve to the image, so as to either boost or lower the inducement of rotation of liquid crystals so as to achieve a desired image luminance (e.g., T1), the combination of boosted and lowered inducements being relative to a static reference luminance-achieving value (V1R) and thus respectively adjust for a desired combination of high and low liquid crystal rotation rates (for viscous liquid crystals) as shall be made clearer when FIG. 5C is described below. Here, the terms "high" and "low" are relative terms referring to an applied gamma curve higher or lower, respectively, than a reference gamma curve RG (which can be any suitable predetermined gamma curve for the corresponding LCD panel). The present disclosure of invention contemplates any numerical values of the high and low gamma curves HG, LG. Similarly, the present disclosure of invention contemplates any luminance values (T) resulting from the utilized combinations of high and low data frames.

For example, when an LCD apparatus has a frame frequency of 480 Hz and the received data are in 3-D image mode, the data generator 270 generates one left eye high data frame and two left eye low data frames from three left data frames of the four left eye data frames except for the black frame data according to a time-division rate that is preset as 1:2, and generates one right eye high data frame and two right eye low data frames from the three right eye data frames of the four right eye data frames except for the black frame data according to the time-division rate that is preset as 1:2. When the received data are in 2-D image mode, the data generator 270 alternately and repeatedly generates the high data frame and the low data frame from the data frames according to a time-division rate that is preset as 1:1.

The panel driver 300 displays the frame image on the LCD panel 400, based on the data provided from the data generator 270 and the control signal provided from the timing controller 250. The panel driver 300 includes a data driver 310 providing a signal to a data line of the LCD panel, and a gate driver 330 providing the signal to the gate line of the LCD panel 400.

For example, when the received data are in 3-D image mode, the panel driver 300 displays (N−1) left eye frame images, a black frame image, (N−1) right eye frame images and the black frame image, corresponding to the received data frame. When the received data are in 2-D image mode, the panel driver 300 displays the M frame images corresponding to the received data frame.

Figure 3:
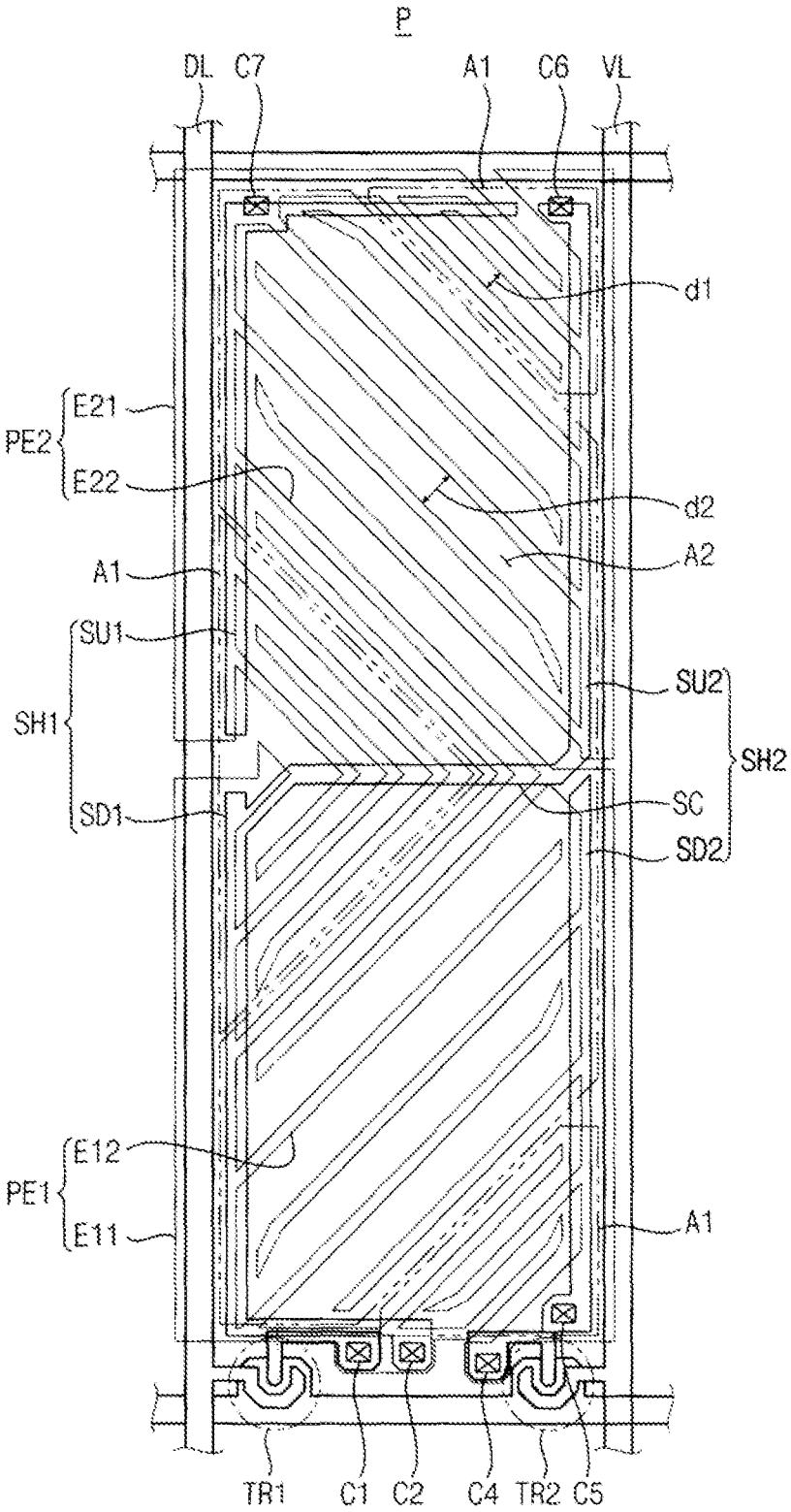
FIG. 3 is a plan view illustrating a liquid crystal display panel in FIG. 11.

FIG. 3 is a plan view illustrating further details of the LCD panel of FIG. 1. FIG. 4 is an equivalent circuit diagram illustrating the LCD panel in FIG. 3.

Referring to FIGS. 3 and 4, the LCD panel 400 includes: a first substrate, a second substrate facing the first substrate, and a liquid crystal layer disposed between the first and second substrates. The first substrate includes a data line DL, a gate line GL, a voltage line VL, first and second switching elements TR1 and TR2, first and second shield portions SH1 and SH2, and first and second pixel electrodes PE1 and PE2. The second substrate includes a color filter and a light blocking pattern.

The LCD panel 400 includes a plurality of pixels. Each of the pixels P includes first and second switching elements TR1 and TR2, first and second shield portions SH1 and SH2, and first and second pixel electrodes PE1 and PE2. The first switching element TR1 includes a control electrode, an input electrode and an output electrode. The control electrode is connected to the gate line GL, the input electrode is connected to the data line DL, and the output electrode is connected to the first pixel electrode PE1 through a first contact hole C1. The second switching element TR2 includes the control electrode, the input electrode and the output electrode. The control electrode is connected to the gate line GL, the input electrode is connected to the voltage line VL, and the output electrode is connected to the second pixel electrode PE2 through a third contact hole C3.

First and second voltages are alternately applied to the voltage line VL during one frame unit. Here, the first voltage is cathodic with respect to a reference voltage, and the second voltage is anodic with respect to the reference voltage. A voltage between the first and second voltages is applied to the data line DL according to a grayscale level. For example, when the first voltage (being cathodic) is applied to the voltage line VL, a voltage higher than the first voltage (being anodic) is applied to the data line DL according to the grayscale level. Alternatively, when the second voltage (being anodic) is applied to the voltage line VL, a voltage lower than the second voltage (being cathodic) is applied to the data line DL according to the grayscale level.

The first shield portion SH1 is disposed adjacent to the data line DL that applies a data voltage to the pixel P. The first shield portion SH1 prevents an electric field of the data line DL from leaking out, and blocks light as well. The first shield portion SH1 includes a first upper shield SU1 and a first lower shield SD1 spaced apart from each other. The first upper shield SU1 is disposed in an upper portion of a pixel area in which the pixel P is defined; and is disposed adjacent to the data line DL. The first lower shield SD1 is disposed in a lower portion of the pixel are in which the pixel P is defined, and is disposed adjacent to the data line DL.

The second shield portion SH2 is disposed adjacent to the voltage line VL. The second shield portion SH2 prevents the electric field from leaking out, and blocks light as well. The second shield portion SH2 includes a second upper shield SU2, a second lower shield SD1 and a connecting shield SC. The second upper shield SU2 and the second lower shield SD2 are spaced apart from each other, and the connecting shield SC connects the first lower shield SD1 with the second upper shield SU2. In addition, the second shield portion SH2 may be disposed adjacent to a neighboring data line that provides data voltages to a neighboring pixel. An end portion of the first upper shield SU1 may extend generally along the data line to be disposed adjacent to the second upper shield SU2, and an end portion of the first lower shield SD1 may extend generally along the data line to be disposed adjacent to the second lower shield SD2.

The first upper shield SU1 is electrically connected to the second pixel electrode PE2 through a seventh contact hole C7, and overlaps with the second pixel electrode PE2. The second lower shield SD2 is electrically connected to the second pixel electrode PE2 through a fifth contact hole C5, and overlaps with the second pixel electrode PE2. The first upper shield SU1 prevents light-leakage between the data line DL and the second pixel electrode PE2, and the second lower shield SD2 prevents light-leakage between the voltage line VL and the second pixel electrode PE2.

The first lower shield SD1 is electrically connected to the first pixel electrode PE1 through a second contact hole C2, and partially overlaps with the data line DL. The second upper shield SU2 is electrically connected to the first pixel electrode PE1 through a sixth contact hole C6 and overlaps with the first pixel electrode PE1. The first lower shield SD1 prevents light-leakage between the data line DL and the first pixel electrode PE1, and the second upper shield. SU2 prevents light-leakage between the voltage line VL and the first pixel electrode PE1.

The first and second shield portions SH1 and SH2 may be formed from a metal layer substantially the same as that of the gate line GL.

The first pixel electrode PE1 includes a first column E11 and a first branch E12. The first column E11 overlaps with the data line DL and the voltage line VL. The first branch E12 extends to the pixel portion (i.e. the interior pixel area of pixel P) from the first column E11, and is inclined at an angle of about 45 degrees (or about 45 degrees). The second pixel electrode PE2 includes a second column E21 and a second branch E22. The second column E21 overlaps with the data line DL and the voltage line VL. The second branch E22 extends to the pixel portion, or interior pixel area of pixel P, from the second column E21, and is inclined by an angle of about 45 degrees (or about −45 degrees). The first branch E12 and the second branch E22 are alternately disposed. The pixel area in which the pixel P is defined is divided into first and second sub areas A1 and A2 according to a gap between the first and second branches E12 and E22. The gap between the first and second branches E12 and E22 in the first sub area A1 has a relatively narrow distance d1, and the gap between the first and second branches E12 and E22 in the second sub area A2 has a relatively wide distance d2. The first sub area A1 may be substantially the same as, or smaller than, the second sub area A2.

The first and second pixel electrodes PE1 and PE2 receive voltages different from each other through the data line DL and the voltage line VL. The first and second pixel electrodes PE1 and PE2 have horizontal electric fields different from each other in the first and second sub areas A1 and A2 according to the gap between first and second branches E12 and E22, and thus liquid crystal molecules may be arranged different from each other in the first and second sub areas A1 and A2. For example, the first and second branches E12 and E22, having the narrow distance d1 in the first sub area A1, form a first liquid crystal capacitor CLCH, and the first and second branches E12 and E22, having the wide distance d2 in the second sub area A2, form a second liquid crystal capacitor CLCL. Thus, the pixel P has a plurality of domains, so that visibility may be enhanced.

The first and second pixel electrodes PE1 and PE2 may be formed as a transparent conductive layer.

Figure 5A:
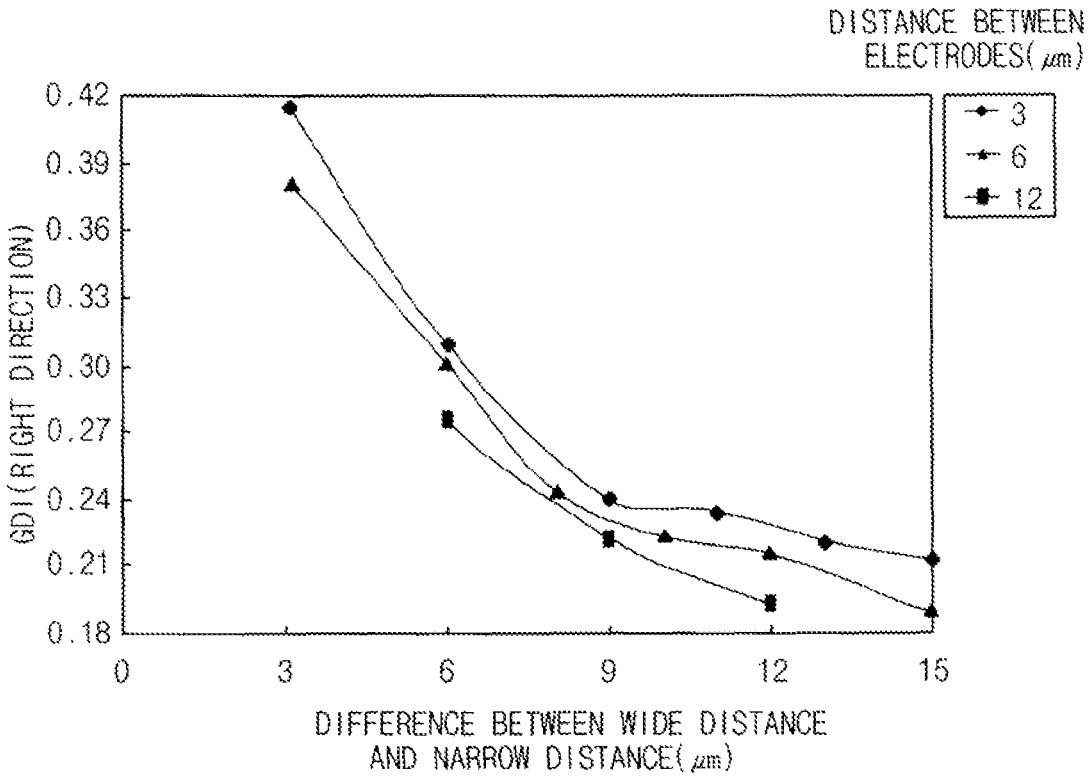
FIG. 5A is a graph showing visibility according to a distance between first and second pixel electrodes in FIG. 3.
Figure 5B:
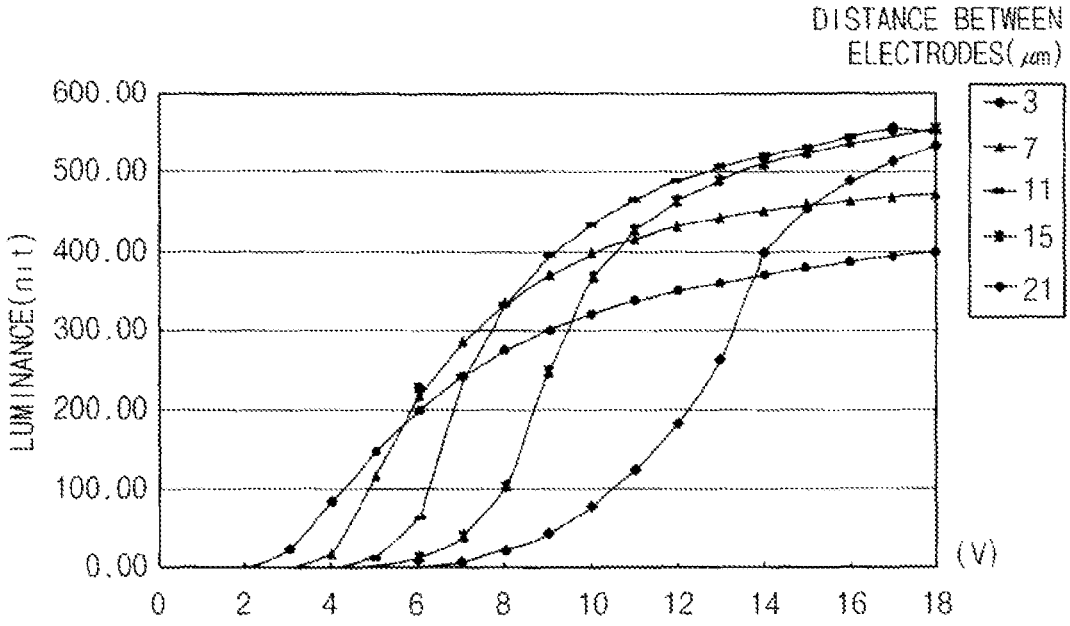
FIG. 5B is a graph showing a V-T curve according to the distance between the first and second electrodes in FIG. 3.
Figure 5C:
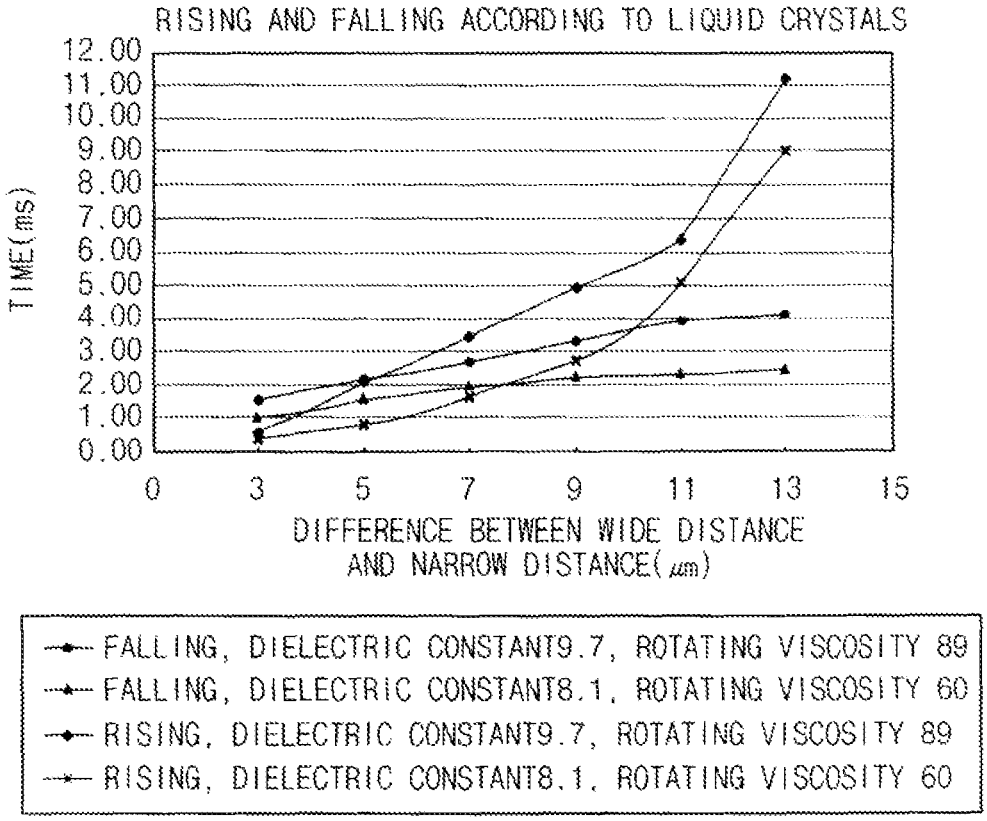
FIG. 5C is a graph showing a rising time and a falling according to the distance between the first and second electrodes in FIG. 3.

FIG. 5A is a graph showing visibility according to a distance between the first and second pixel electrodes of FIG. 3. FIG. 5B is a graph showing a V-L curve according to the distance between the first and second electrodes of FIG. 3. FIG. 5C shows rise time and falling time according to the distance between the first and second electrodes of FIG. 3.

Referring to FIGS. 3 and 5A, a simulation result of GDI (Gamma Distortion Index) (right direction) as a function of the magnitude of the wide distance d2 in the second sub area A2 is shown when the narrow distance d1 is 3 μm, 6 μm and 9 μm. The right visibility is a difference between a luminance measured at front (90 degrees) and a luminance measured at side (30 degrees). Thus, difference of the luminances is smaller, the visibility is more enhanced. According to the simulation result, when the narrow distance d1 is 3 μm, 6 μm and 9 μm and the wide distance d2 is not less than 9 μm, the GDI (right direction) is not more than about 0.24. Thus, as the wide distance d2 increases, a GDI (right direction) is further enhanced.

The graph showing the V-L curve according to the distance between the first and second electrodes in FIG. 5B, may explain the reason on the above result. Referring to FIG. 5B, a difference between a luminance at a high voltage and a luminance at a low voltage is more noticeable when the distance between the first and second pixel electrodes is wide than when the distance between the first and second pixel electrodes is narrow. For example, when the distance between the first and second pixel electrodes is 3 μm, the difference corresponding to a penetration ratio at a voltage of 6V is about 200 nit, and the difference corresponding to the penetration ratio at a voltage of 18V is about 400 nit. However, when the distance between the first and second pixel electrodes is 21 μm, the difference corresponding to the penetration ratio at a voltage of 6V approaches 0 nit, and the difference corresponding to the penetration ratio at a voltage of 18V is about 540 nit. Accordingly, the difference between the luminance at the high voltage and the luminance at the low voltage is more noticeable as the distance between the first and second pixel electrodes increases. Thus, as the distance between the first and second pixel electrodes increases, visibility is more enhanced.

The distance between the first and second electrodes affects a rising time and a falling time of a liquid crystal. Referring to FIG. 5C, the rising times and falling of various liquid crystals according to the distances between the first and second pixel electrodes are measured.

When the distance between the first and second pixel electrodes is not more than 11 μm, the rising time is not more than about 6 ms. For example, a fast response speed of the liquid crystal is desirable for the LCD panel having a frame frequency of 480 Hz. In this case, the rising time is preferably about 4 ms, and a falling time is preferably about 2 ms. Under these conditions then, the wide distance d2 between the first and second pixel electrodes PE1 and PE2 should not exceed about 11 μm. The narrow distance d1 between the first and second pixel electrodes should not be less than about 5 μm considering manufacturing conditions.

Referring to FIGS. 5A, 5B and 5C, a narrow distance d1 of not more than about 11 μm and a wide distance of not less than about 5 μm may be effective given the above conditions.

Figure 6:
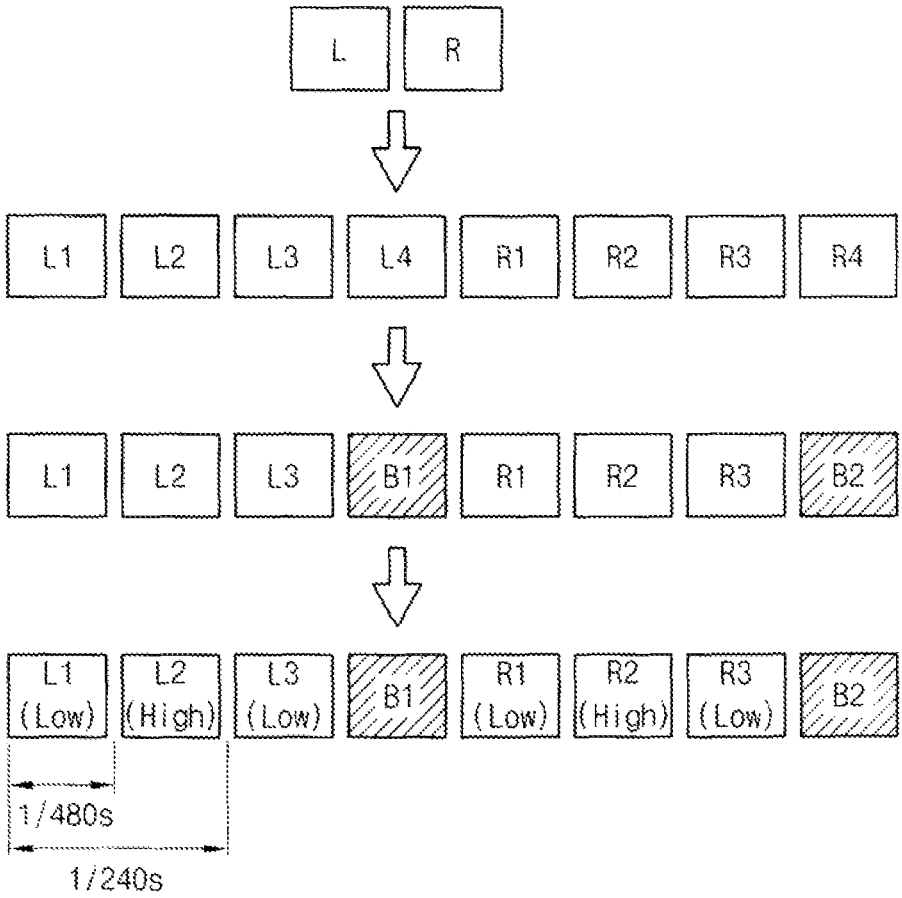
FIG. 6 is a conceptual diagram explaining a method of displaying a tree-dimensional (3-D) image using the liquid crystal display apparatus in FIG. 1.

FIG. 6 is a conceptual diagram explaining a method of displaying a 3-D image using the LCD apparatus of FIG. 1. Hereinafter, the method is explained for an LCD apparatus having a frame frequency of 480 Hz.

Referring to FIGS. 1, 2, and 6, the mode decider 210 decides the image mode of the received data as the 3-D image mode, using the received synchronizing signal, the mode information signal, etc, or according to a mode signal selected by a user. The frame rate controller 230, the timing controller 250 and the data generator 270 are driven based on a mode deciding signal of the mode decider 210.

The frame rate controller 230 divides the received data frame into left eye data and right eye data for the 3-D image mode, scales each of the left eye data and the right eye data to the resolution of the LCD panel 400, and generates the left eye data frame and the right eye data frame. Then, the frame rate controller 230 repeats the left data frame to generate four left eye data frames L1, L2, L3 and L4, and repeats the right data frame to generate four right eye data frames R1, R2, R3 and R4.

The timing controller 250 generates the black data frame and inserts the black data frame between the left data frame and the right data frame for 3-D image mode. Accordingly, the timing controller 250 sequentially outputs a first left eye data frame L1, a second left eye data frame L2, a third left eye data frame L3, a left eye black data frame B1, a first right eye data frame R1, a second right eye data frame R2, a third right eye data frame R3 and a right eye black data frame B2.

The data generator 270 generates the high data frame or the low data frame from each of the eight data frames provided from the timing controller 250 according to a time-division rate preset as 1:2 for the 3-D image mode, and outputs either the high data frame or the low data frame. For example, the data generator 270 generates a first left eye low data frame L1 (Low) from the left eye data frame L1 using the second data table 272, generates a second left high data frame L2 (High) from the second left eye data frame L2 using the first data table 271, generates a third left eye low data frame L3 (Low) from a third left eye data frame L3 using the second data table 272, and outputs the left eye black data frame B1 as is, without alteration.

In addition, the data generator 270 generates a right eye low data frame R1 (Low) from the first right eye data frame R1 using the second data table 272, generates a second right eye high data frame R2 (High) from the second right eye data frame R2 using the first data table 271, generates a third right eye low data frame R3 (Low) from the third right eye data frame R3 using the second data table 272, and outputs the right eye black data frame B2 as is, without alternation.

The panel driver 300 sequentially displays the first left eye low data frame L1 (Low), the second left eye high data frame L2 (High), the third left eye low data frame L3 (Low), the left eye black data frame B1, the first right eye low data frame R1 (Low), the second right eye high data frame R2 (High), the third right eye low data frame R3 (Low) and the black data frame B2 on the LCD panel 400.

According to the present example embodiment, the pixel of the LCD panel 400 is space-divided into a plurality of sub areas, and the high data frame and the low data frame are time-divided to be displayed on the LCD panel 400, so as to enhance visibility of the 3-D image.

Figure 7:
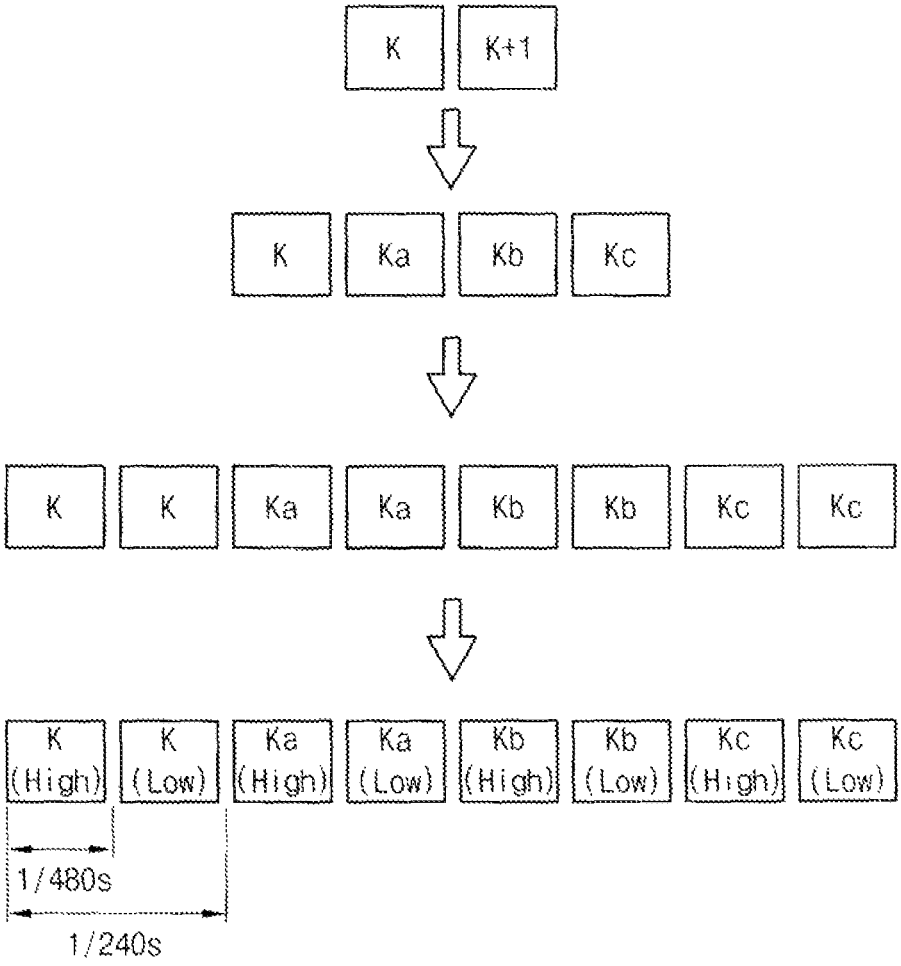
FIG. 7 is a conceptual diagram explaining a method of displaying a two-dimensional (2-D) image using the liquid crystal display apparatus in FIG. 1.

FIG. 7 is a conceptual diagram explaining a method of displaying a 2-D image using the LCD apparatus in FIG. 1. Hereinafter, the method is explained for the case in which the LCD apparatus has a frame frequency of 480 Hz.

Referring to FIGS. 1, 2 and 7, the mode-decider 210 decides the image mode of the received data as the 2-D image mode, using the received synchronizing signal, the mode information signal, etc., or according to the mode signal selected by the user. The frame rate controller 230, the timing controller 250 and the data generator 270 are driven based on the mode deciding signal of the mode decider 210.

The frame rate controller 230 generates three interpolated data frames Ka, Kb and Kc between a K-th data frame K and a (K+1)-th data frame (K+1), using the K-th data frame K and the (K+1)-th data frame (K+1). This is accomplished by preferably using any motion estimation ME and interpolation method MC for the 2-D image mode. Each of the K-th data frame K and three interpolated data frames. Ka, Kb and Kc are doubled to generate, in order, eight data frames K, K, Ka, Ka, Kb, Kb, Kc and Kc.

The timing controller 250 outputs the eight data frames K, K, Ka, Ka, Kb, Kb, Kc and Kc received from the frame rate controller 230 to the data generator 270 according to the 2-D image mode as they are, without modification.

The data generator 270 generates the high data frame or the low data frame from each of the eight data frames K, K, Ka, Ka, Kb, Kb, Kc and Kc, and outputs the high data frame or the low data frame, according to a time-division rate preset as 1:1 for the 2-D image mode. For example, the data generator 270 generates and outputs a K-th high data frame K (High), a K-th low data frame K (Low), a first interpolated high data frame Ka (High), a first interpolated low data frame Ka (Low), a second interpolated high data frame Kb (High), a second interpolated low data frame Kb (Low), a third interpolated high data frame Kc (High) and a third interpolated low data frame Kc (Low).

The panel driver 300 sequentially displays the K-th high data frame K (High), the K-th low data frame K (Low), the first interpolated high data frame Ka (High), the first interpolated low data frame Ka (Low), the second interpolated high data frame Kb (High), the second interpolated low data frame Kb (Low), the third interpolated high data frame Kc (High) and the third interpolated low data frame Kc (Low) that are provided from the data generator 270, on the LCD panel 400.

According to the present example embodiment, the pixel of the LCD panel 400 is space-divided into a plurality of sub areas, and the high data frame and the low data frame are time-divided to be displayed on the LCD panel 400, thus enhancing visibility of the 2-D image.

Measurement of Visibility Using Space-Division Method

Table 1 shows data of a GDI (right direction) according to an area ratio between the first and second sub areas A1 and A2 in the LCD panel of FIG. 3.

The first and second pixel electrodes of the LCD panel 400 have a narrow distance d1 of 5 μm in the first sub area, and a wide distance d2 of 11 μm in the second sub area A2 for satisfying a specific response. In this case, a GDI (right direction) according to the area ratio between the first and second sub areas A1 and A2 was measured.

TABLE 1

| Distance between electrodes | Narrow distance(d1): 5 μm/ Wide distance(d2): 11 μm | | | | | |
|---|---|---|---|---|---|---|
| Area ratio (A1:A2) | 1:1 | 1:2 | 1:3 | 1:4 | 1:5 | 1:6 |
| GDI (right direction) | 0.321 | 0.307 | 0.300 | 0.296 | 0.295 | 0.294 |

Referring to Table 1, when the ratio between the first and second areas A1 and A2 was 1:1, a GDI (right direction) was 0.321. When a ratio between the first and second sub areas A1 and A2 was 1:2, a GDI (right direction) was 0.307. When a ratio between the first and second sub areas A1 and A2 was 1:3, a GDI (right direction) was 0.300. When the ratio between the first and second sub areas A1 and A2 was 1:4, a GDI (right direction) was 0.296. When the ratio between the first and second sub areas A1 and A2 was 1:5, a GDI (right direction) was 0.295. When a ratio between the first and second sub areas A1 and A2 was 1:6, a GDI (right direction) was 0.294. Thus, as the second sub area A2 was made larger than the first sub area A1, visibility was increasingly enhanced.

Measurement of Visibility Using Time-Division Method

Figure 8A:
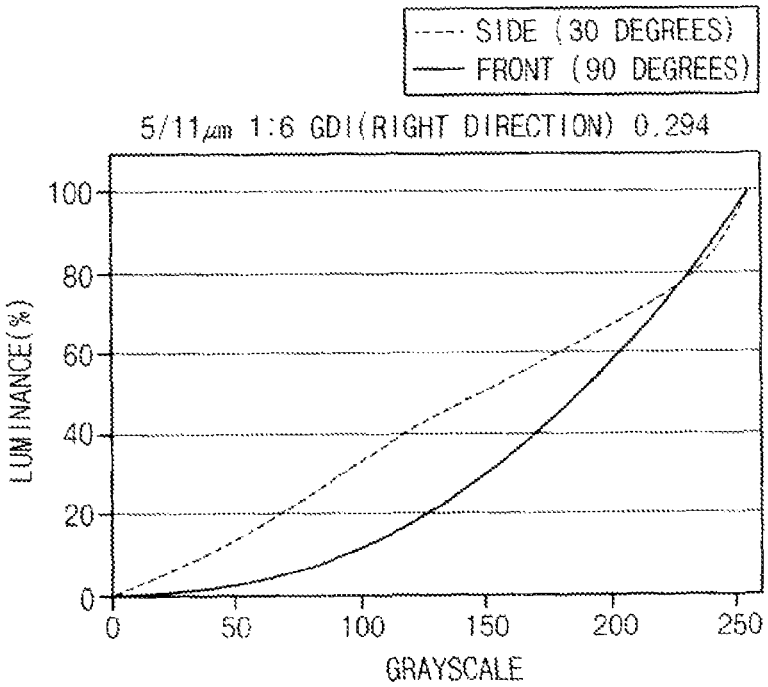
FIG. 8A is a graph showing a visibility of the image of a liquid crystal display apparatus according to a comparative example embodiment.
Figure 8B:
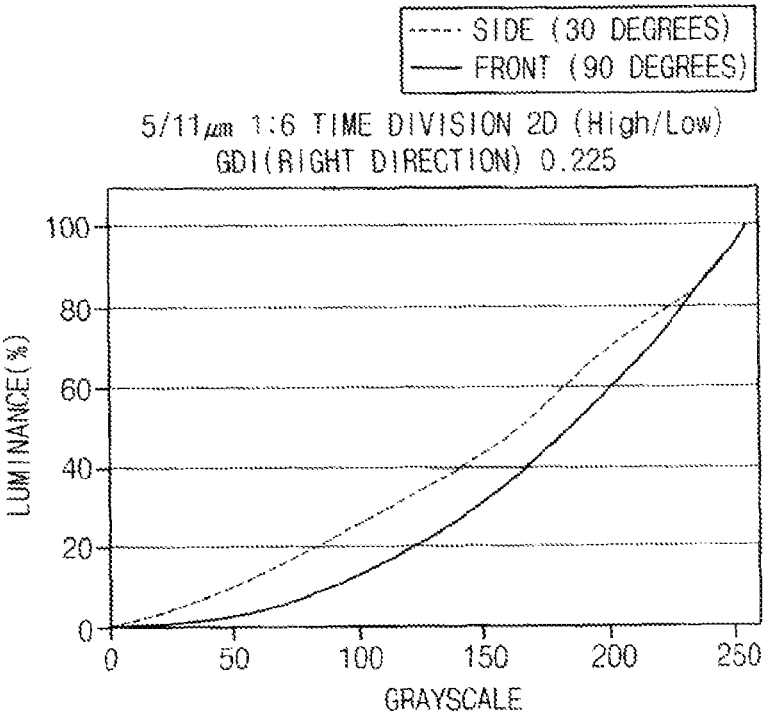
FIG. 8B is a graph showing visibility of the 2-D image time-divided by the liquid crystal display apparatus in FIG. 1.
Figure 8C:
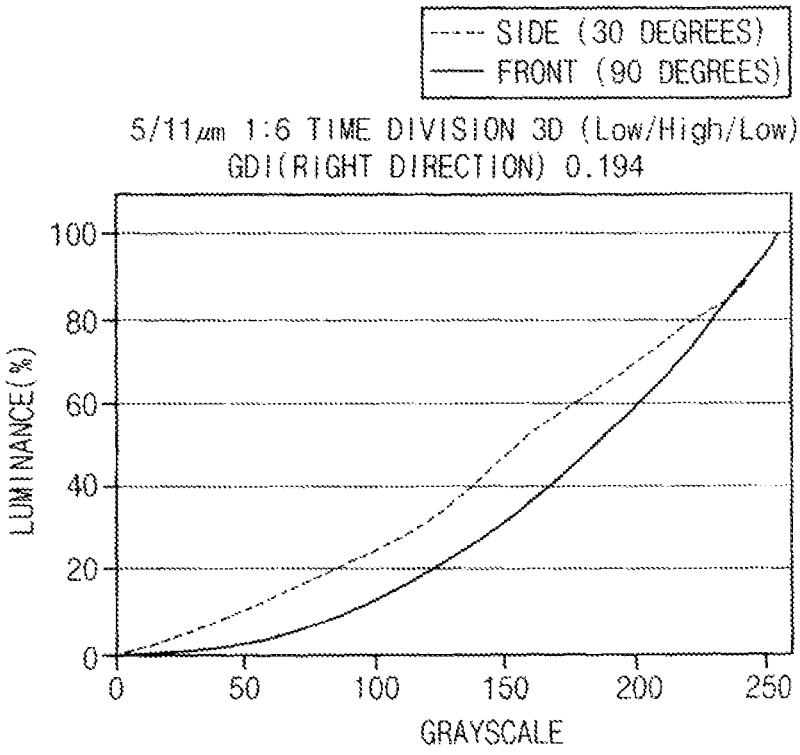
FIG. 8C is a graph showing visibility of the 3-D image time-divided by the liquid crystal display apparatus in FIG. 1.

FIG. 8A is a graph showing a visibility of the image of an LCD apparatus according to a comparative example embodiment. FIG. 8B is a graph showing a visibility of a 2-D image time-divided by the LCD apparatus of FIG. 1. FIG. 8C is a graph showing a visibility of a 3-D image time-divided by the LCD apparatus of FIG. 1.

Referring to FIGS. 8A, 8B and 8C, the first and second pixel electrodes have a narrow distance d1 of 5 μm in the first sub area and a wide distance d2 of 11 μm in the second sub area A2.

Referring to FIG. 8A, a right visibility of the LCD apparatus according to the comparative example embodiment is shown when the first and second areas A1 and A2 are space-divided by a ratio of 1:6 in a 2-D image, without the time-division. As above, a GDI (right direction) was about 0.294 in the LCD apparatus according to the comparative example embodiment.

Referring to FIG. 83, a right visibility of the LCD apparatus according to the present example embodiment is shown, when the first and second areas A1 and A2 are space-divided by a ratio of 1:6, the high and low data frames are time-divided by a ratio of 1:1 and the 2-D image is displayed. In this case, the GDI (right direction) is about 0.255.

Referring to FIG. 8C, the right visibility of the LCD apparatus according to the present example embodiment is shown when the first and second areas A1 and A2 are space-divided by the ratio of 1:6, the high and low data frames are time-divided by the ratio of 1:2 and a 3-D image is displayed. In this case, the GDI (right direction) is about 0.194.

Referring to FIGS. 8A, 8B and 8C, a GDI (right direction) is more enhanced when both of the space-division and time division methods are applied, compared to the GDI (right direction) when the space-division method is only applied. For example, the GDI (right direction) is dramatically enhanced when the 3-D image is driven in a condition that the high and low data frames are time-divided by the ratio of 1:2, compared to the GDI (right direction) when the space-division method is only applied.

Table 2 shows a response speed of grayscales when a narrow distance between the first and second pixel electrodes is 4 μm, a wide distance between the first and second pixel electrodes is 12 μm, and a rotational viscosity of a liquid crystal is 82.

TABLE 2

| Grayscale | | END | | | | | | | | | |
|---|---|---|---|---|---|---|---|---|---|---|---|
| | | 0 | 31 | 63 | 95 | 127 | 159 | 191 | 223 | 255 | |
| START | 0 | | 3.80 | 2.81 | 2.03 | 2.19 | 4.57 | 5.65 | 6.79 | 4.58 | Rising time |
| | 31 | 1.52 | | 3.04 | 1.90 | 2.25 | 4.32 | 5.49 | 6.64 | 4.40 | |
| | 63 | 1.21 | 3.27 | | 1.74 | 2.22 | 4.35 | 5.71 | 6.63 | 4.03 | |
| | 95 | 1.23 | 1.83 | 3.49 | | 2.05 | 3.91 | 5.90 | 6.82 | 3.74 | |
| | 127 | 1.31 | 1.73 | 2.44 | 4.68 | | 3.40 | 6.18 | 6.03 | 3.02 | |
| | 159 | 1.46 | 1.81 | 2.33 | 2.83 | 5.06 | | 8.41 | 4.65 | 4.98 | |
| | 191 | 1.68 | 1.99 | 2.50 | 2.97 | 4.56 | 6.35 | | 3.89 | 1.37 | |
| | 223 | 1.94 | 2.25 | 2.78 | 3.22 | 4.52 | 5.25 | 5.71 | | 0.91 | |
| | 255 | 2.37 | 2.61 | 3.10 | 3.50 | 4.49 | 4.98 | 4.80 | 3.25 | | |
| | Falling time | | | | | | | | | | |

Referring to Table 2, a falling time, which refers to a time to drop from a high grayscale to a low grayscale, is more satisfactory when the high grayscale moves to the black grayscale, compared to when the low grayscale moves to the black grayscale. For example, the falling time is 1.52 ms when moving from 31 grayscale START to 0 grayscale END, the falling time is lowest, i.e. about 1.21 ms when moving from 63 grayscale START to 0 grayscale END, the falling time is 1.23 ms when moving from 95 grayscale START to 0 grayscale END, and the falling time is 1.31 ms when moving from 127 grayscale START to 0 grayscale END. In contrast, the falling time is 2.37 ms when moving from the high grayscale which is 255 grayscale START to 0 grayscale END.

A rising time which refers to a time to rise up from a low grayscale to a high grayscale, is fastest when the black grayscale moves to the low grayscale, compared to when the black grayscale moves to the high grayscale. For example, the rising time is 3.80 ms when moving from 0 grayscale START to 31 grayscale END, the rising time is 2.81 ms when moving from 0 grayscale START to 63 grayscale END, the rising time is 2.03 ms when moving from 0 grayscale START to 95 grayscale END, and the rising time is 2.19 ms when moving from 0 grayscale START to 127 grayscale END. In contrast, the rising time is 4.58 ms when moving from 0 grayscale START to 255 grayscale END.

According to the present example embodiment, the black data frame is inserted between the left eye data frame and the right eye data frame at the 3-D image mode. Referring to Table 2, when the time-division method at the 3-D image mode is used, a response speed is faster when a low data frame is positioned before and after the black data frame. As mentioned referring to FIG. 6, a response speed may be more enhanced when the third left eye low data frame L3 (Low) is displayed before the left black data frame B1 is displayed, and the first right eye low data frame R1 (Low) is displayed after the left eye black data frame B1 is displayed, so that the response speed may be more enhanced.

According to the present example embodiments, the 3-D image is displayed as a high frequency frame to prevent crosstalk between the left and right eye images. In addition, the pixel is space-divided into first and second sub areas A1 and A2 in which the distances between the first and second pixel electrodes are different from each other, and the high data and the low data are time-divided for display on the pixel. This arrangement results in enhanced visibility.

While the present disclosure of invention has been particularly provided with reference to example embodiments thereof, it will be understood by those of ordinary skill in the art in view of the foregoing that various changes in form and details may be made therein without departing from the spirit and scope of the present teachings.

What is claimed is:

1. A method of driving a liquid crystal display (LCD) panel, the method comprising:

generating a plurality of data frames from a data frame;

generating a left eye data frame and a right eye data frame from the data frames;

generating a plurality of left eye data frames from the left eye data frame;

generating a plurality of right eye data frames from the right eye data frame;

inserting a black data frame between the plurality of left eye data frames and the plurality of right eye data frames;

generating a high data frame from one of the generated plurality of data frames, the high data frame having a relatively high luminance, generating a first high data frame having the high luminance and a first low data frame having the low luminance from the left eye data frames according to the time-division rate;

generating a low data frame from another of the generated plurality of data frames, the low data frame having a luminance less than the relatively high luminance of the high data frame, the luminance of the high data frame and the luminance of the low data frame configured to input data;

generating a second high data frame having the high luminance and a second low data frame having the low luminance from the right eye data frames according to the time-division rate; and displaying the high data frame and the low data frame on the LCD panel according to a time division rate, wherein the black data frame is inserted between the first low data frame of the left eye data frames and the second low data frame of the right eye data frames.

2. The method of claim 1, wherein the displaying further comprises:

displaying the first high data frame and the first low data frame on the LCD panel according to the time-division rate;

displaying a left eye black data frame on the LCD panel;

displaying the second high data frame and the second low data frame on the LCD panel according to the time-division rate; and displaying a right eye black data frame on the LCD panel.

3. An LCD apparatus comprising:

an LCD panel comprising a plurality of pixels;

a frame rate controller configured for generating a plurality of data frames;

a data generator configured for generating a high data frame from one of the generated plurality of data frames, the high data frame having a relatively high luminance, the data generator being further configured for generating a low data frame from another of the generated plurality of data frames, the low data frame having a luminance that is less than the relatively high luminance of the high data frame, the luminance of the high data frame and the luminance of the low data frame configured to input data;

a panel driver configured for driving the LCD panel with both of the high data frame and the low data frame according to a time division rate; and a timing controller for inserting a black data frame between the plurality of left eye data frames and the plurality of right eye data frames;

wherein the frame rate controller is configured to generate a left eye data frame and a right eye data frame, to generate a plurality of left eye data frames from the left eye data frame, and to generate a plurality of right eye data frames from the right eye data frame, wherein the data generator is configured to generate a first high data frame having the high luminance and a first low data frame having the high luminance from the left eye data frames according to the time-division rate, and to generate a second high data frame having the high luminance and a second low data frame having the high luminance from the right eye data frames according to the time-division rate, and wherein the panel driver is configured to display the low data frames before and after displaying the black data frame on the liquid crystal display panel.

4. The LCD apparatus of claim 3, wherein the panel driver is configured to display the first high data frame and the first low data frame according to the time-division rate on the LCD panel, and then display a left eye black data frame on the LCD panel, and to display the second high data frame and the second low data frame according to the time-division rate on the LCD panel, and then display the right eye black data frame on the LCD panel.

5. The LCD apparatus of claim 3, wherein each of the pixels of the LCD panel comprises:

a first switching element electrically connected to a gate line and a data line crossing the gate line;

a second switching element electrically connected to the gate line and a voltage line substantially parallel to the data line;

a first pixel electrode electrically connected to the first switching element; and a second pixel electrode spaced apart from the first pixel electrode, and electrically connected to the second switching element.

6. The LCD apparatus of claim 5, wherein each of the pixels further comprises first and second sub areas, the corresponding first and second pixel electrodes are spaced apart from each other by a first distance in the first sub area, and the corresponding first and second pixel electrodes are spaced apart from each other by a second distance larger than the first distance in the second sub area.

7. The LCD apparatus of claim 6, wherein the first sub area is substantially the same as or smaller than the second sub area.

8. The LCD apparatus of claim 5, wherein the frame unit is configured to apply first and second voltages to the voltage line, the first and second voltages having opposite polarities with respect to a reference voltage.

* * * * *